US005543811A

United States Patent [19]

Chethik

[11] Patent Number: 5,543,811

[45] Date of Patent: Aug. 6, 1996

[54] TRIANGULAR PYRAMID PHASED ARRAY ANTENNA

[75] Inventor: Frank Chethik, Palo Alto, Calif.

[73] Assignee: Loral Aerospace Corp., New York, N.Y.

[21] Appl. No.: 384,789

[22] Filed: Feb. 7, 1995

[51] Int. Cl.[6] ..... H01Q 21/00

[52] U.S. Cl. ..... 343/844; 343/853; 343/893

[58] Field of Search ..... 343/700 MS, 853, 343/844, 878, 893; 342/371, 372, 368, 367, 355; H01Q 21/00

[56] References Cited

U.S. PATENT DOCUMENTS

| | | | |
|---|---|---|---|
| 1,640,534 | 8/1927 | Conrad | 343/745 |
| 2,029,015 | 1/1936 | Bohm | 250/33 |
| 2,352,216 | 6/1944 | Melvin et al. | 35/12 |
| 3,340,530 | 9/1967 | Sullivan et al. | 343/100 |
| 3,564,552 | 2/1971 | Fraizer, Jr. | 343/778 |
| 3,648,284 | 3/1972 | Dax et al. | 343/5 R |
| 3,699,574 | 10/1972 | O'Hara et al. | 343/16 M |
| 4,384,290 | 5/1983 | Pierrot et al. | 343/6 A |
| 4,896,160 | 1/1990 | Miller, Jr. | 342/368 |
| 4,922,257 | 5/1990 | Saito et al. | 342/377 |
| 5,034,751 | 7/1991 | Miller, Jr. | 342/368 |
| 5,173,706 | 12/1992 | Urkowitz | 342/99 |

FOREIGN PATENT DOCUMENTS

| | | | |
|---|---|---|---|
| 2552273 | 3/1985 | France | 343/700 MS |
| 56-169134 | 4/1983 | Japan . | |

*Primary Examiner*—Donald T. Hajec
*Assistant Examiner*—Hoanganh Le
*Attorney, Agent, or Firm*—Perman & Green

[57] ABSTRACT

A phased array antenna (PAA) that is particularly adapted to accommodate communications with low earth orbiting (LEO) satellites includes three antenna faces which comprise a phased array of radiating elements, each antenna face is triangular and the three faces form a triangular pyramid. Each triangular face has a height h and a base length B. B and h are chosen to optimize the antenna's gain variation with beam elevation angle to compensate for the path losses dependent on beam elevation angle. At low elevation, increased free space loss in incurred due to longer range to a low earth orbiting satellite, and more rain and atmospheric loss is incurred due to longer path through the atmosphere compared with the losses at higher elevations or at zenith. Since the intrinsic shape compensates for the elevation dependent losses, the PAA design minimizes total array area compared with other known geometries and thus exhibits lower cost.

4 Claims, 6 Drawing Sheets

TRIANGULAR PYRAMID PHASED ARRAY ANTENNA

The United States Government has rights in this invention pursuant to U.S. Air Force Contract ESMC-5.

FIELD OF THE INVENTION

This invention relates to satellite communications antennas and more particularly to a phased array antenna (PAA) geometry for use in a satellite earth station that is particularly well suited to applications where the antenna is required to point anywhere in its visible hemisphere. This is particularly so in systems that communicate with low earth orbiting satellites in frequency bands where atmospheric attenuation is an important factor in the communications path.

BACKGROUND OF THE INVENTION

Many satellite earth stations are required to operate with no on-site personnel during routine operations. The PAA is particularly well suited to this requirement in that it has no moving parts, and its functions can be automated and/or remotely controlled. Moreover, the PAA can generate multiple simultaneous contact beams for transmitting or receiving. In applications where simultaneous contact with multiple satellites is required (earth terminal gateways for low altitude multiple satellite systems such as Iridium, Global-Star and Teledesic), the PAA is advantageous because of cost advantages and operational simplicity.

The satellite earth station must, in these example systems, provide a consistent quality of service (gain divided by system noise temperature, G/T, and effective isotropic radiated power, EIRP) over hemispheric coverage range, above a specified critical minimum elevation angle.

For most satellite operating frequency bands, atmospheric attenuation is a significant loss factor that drives the design requirements of the antenna system. For low elevation angular paths, more loss is encountered since the path through the atmosphere itself is longer compared with high elevations (>30° or so). The PAA may be designed to provide more gain at low elevation angles so that the atmospheric losses are approximately compensated.

A phased array antenna utilizing fixed, planar, apertures and designed to provide electronic beam scanning throughout a hemisphere, requires a minimum of three apertures or faces. All array elements constituting the three faces operate in concert to produce multiple simultaneous beams, each capable of nearly hemispheric coverage. As viewed from any aspect, all visible faces participate in beam forming. In this manner, several faces may participate in the generation of any particular transmit or receive beam. Where individual elements and arrays of elements are capable of significant gain at large angular offsets from the normal to the array surface, such elements are useful in contributing to beam gain. From many viewing angles several faces of a multi-faceted phased array are visible, and all may combine their constituent elements to form beams.

The prior art includes many teachings regarding various antenna configurations which provide beam steering capabilities. U.S. Pat. Nos. 4,384,290 to Pierrot et al. and 3,699,574 to O'Hara et al. illustrate circular antenna arrays that are positioned on the skin of an airborne vehicle. U.S. Pat. Nos. 4,896,160 and 5,034,751 to Miller, Jr. illustrate the use of planar phased arrays on airborne vehicles. U.S. Pat. Nos. 2,029,015 to Bohm, 2,352,216 to Melvin et al., and 1,640,534 to Conrad all disclose wire antenna systems that enable beam steering actions. U.S. Pat. No. 3,340,530 to Sullivan et al. discloses a directional antenna array which comprises a plurality of corner reflectors having triangular shaped radiators. U.S. Pat. No. 3,648,284 to Dax et al. illustrates various phased array configurations and, in particular, a two radiating phased arrays which enable bi-lateral beam operation.

U.S. Pat. No. 4,922,257 illustrates a phased array configuration wherein the antenna elements are positioned on a hemisphere. Such an antenna shape illustrates the drawbacks of a number of phased array configurations, in that their aperture size varies from a maximum when a considering a source at zenith, to a minimum, when considering a source at the horizon. More specifically, the cross-section of the antenna structure shown in '257 patent exhibits a circular cross-section when approached from zenith but only a semi-circular cross-section when approached from horizon. As a result, the elevation versus gain characteristic of such an antenna is mismatched to low attitude satellite applications.

Japanese published patent application 58/70181 of Toshitsuna illustrates a phased array system wherein, in one configuration, three radiating faces are rotated mechanically while the beams directed from the individual faces are electronically scanned. The Toshitsuna phased array antenna scans in the vertical dimension only and uses mechanical rotation for azimuth tracking.

U.S. Pat. No. 3,564,552 to Fraizer, Jr. discloses a phased-array antenna that is configured in the form of a square-based pyramid. Such a pyramidal antenna shape experiences a substantial variation in aperture cross-section with azimuth. Generally, only two out of four of such an antenna's surfaces are useful when the beam angles are at or near the horizon.

Accordingly, it is an object of this invention to provide an improved phased array antenna configuration that exhibits maximal aperture cross-section at low beam angles.

It is another object of this invention to provide an improved phased-array antenna whose design enables the achievement of a gain characteristic that does not fall below a predetermined threshold, for all beam angles from zenith to a critical minimum elevation angle.

SUMMARY OF THE INVENTION

A phased array antenna that is particularly adapted to accommodate satellite communications includes three antenna faces, each antenna face including an array of antenna elements, each antenna face arranged in the form of a triangular pyramid and having a triangular shape. Each triangular antenna face has a height h and a base length B. The height h and base length B are selected to assure, for any beam between a minimum beam elevation angle and a beam at zenith, that the cross-section of the antenna aperture exhibits a gain that exceeds the zenith gain by a factor of at least the excess atmosphere, rain and path losses anticipated at the minimum elevation angle. Thus, the antenna structure compensates for losses at low elevation angles that are the result of path, atmospheric and rain attenuation.

The pyramidal shape is preferably higher than it is wide by a factor determined by several parameters: These include the transmission frequency, the atmospheric and statistical rain loss, and the increase in path length free space loss. These path parameters are impacted by the antenna location, satellite orbit geometry and the statistical availability required of the antenna to support the communications mission.

DETAILED DESCRIPTION OF THE INVENTION

Figure 1:
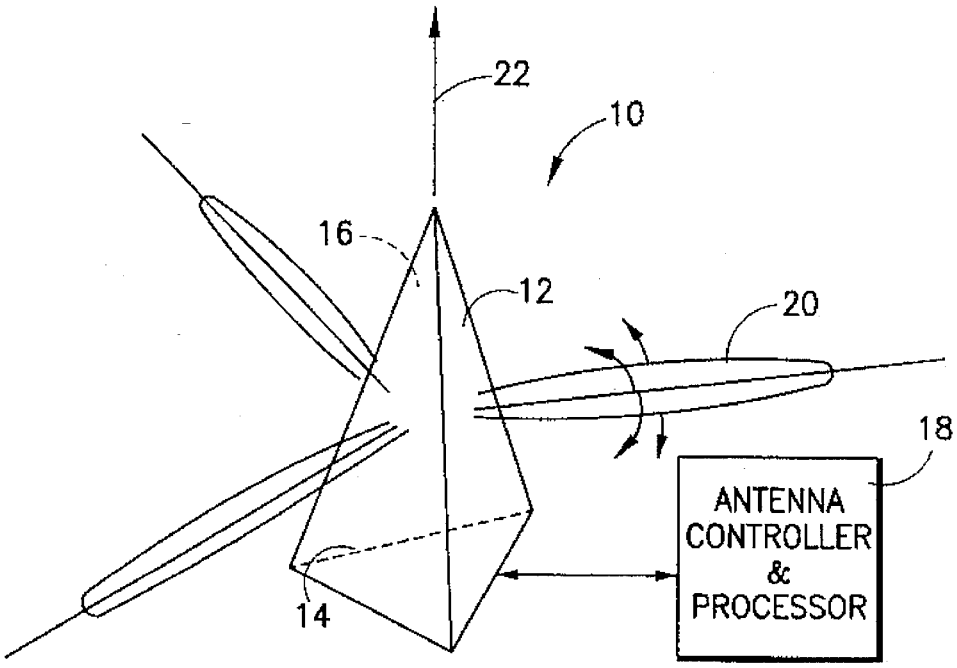
FIG. 1 is a perspective view of a triangular pyramidal phased array antenna embodying the invention.

Referring to FIG. 1, a triangular, pyramidal, phased array antenna 10 includes active faces 12, 14 and 16, each active face including a triangular array of phased array antenna elements (shown schematically). Each active face is controlled by an antenna controller and processor 18 to manifest a beam pattern 20 which may be steered in azimuth both vertically and horizontally. While each beam pattern 20 is illustrated as being formed by an active face, those skilled in the art will realize that a beam pattern 20 may be formed by contributions from all active faces that are "visible" from an extended beam azimuth.

Assuming that phased array antenna 10 is employed for satellite communications, signal loss at zenith (as indicated by arrow 22) will be a minimum when compared to losses which occur at lower beam elevation angles. Hereafter, the term "excess path attenuation" will be employed. Excess path attenuation is signal attenuation that is in excess of beam path attenuation (under the same conditions) when the beam is positioned at zenith (thereby communicating with an orbiting LEO satellite at its closest point of passage). As will become apparent from the description that follows, by optimizing the height to base ratio of antenna 10, higher gain is provided for low beam elevations, where excess path attenuation is greater. More specifically, the aperture size of antenna 10 exhibits a larger cross-section area in a plane normal to the beam axis at low beam angles so as to compensate for added excess path attenuation.

Figure 2A:
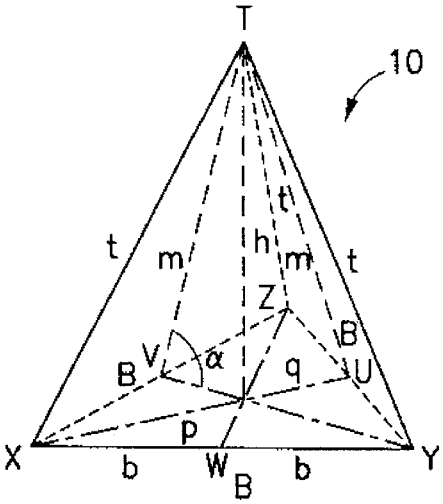
FIG. 2A is an illustration of the geometry of the triangular pyramidal phased array antenna of FIG. 1.
Figure 2B:
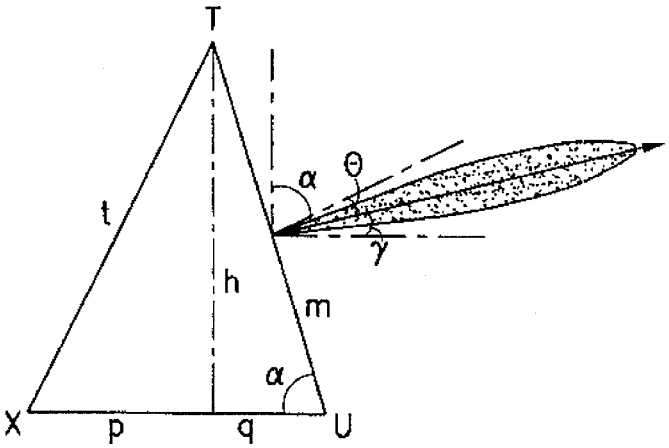
FIG. 2B is a side view of the antenna geometry of FIG. 2A.

The geometry of triangular, pyramidal, phased array antenna 10 is shown in FIGS. 2A and 2B. FIG. 2B is a section through the geometrical construct of FIG. 2A along the plane XTU. Dimension B is the base length of the pyramid, h the pyramid's height, $\alpha$ the slant angle of each active antenna face, $\theta$ the antenna scan angle off broadside, and $\gamma$ the elevation angle.

Figure 3:
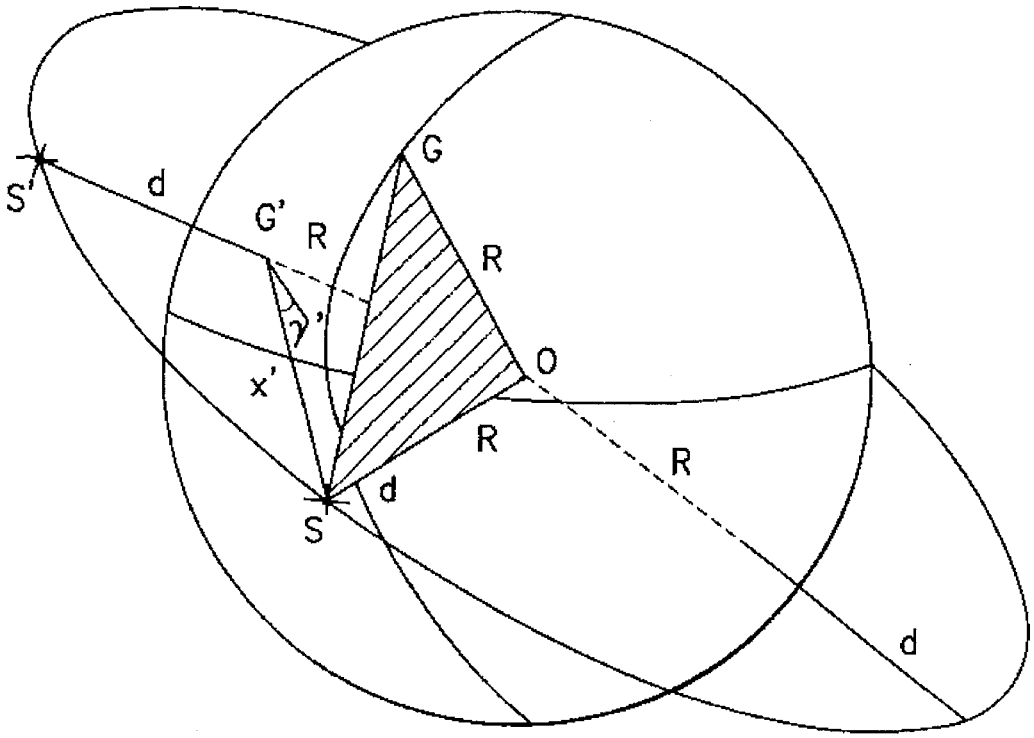
FIG. 3 is an illustration showing satellite geometry for a low earth orbiting satellite.

As shown in FIG. 3, d is the altitude of a LEO satellite measured from the surface of the earth, 0 is the earth's center point, R is the radius of the earth (6378 Km), x is the range between a satellite S and a ground station G, and $\gamma$ is the beam elevation angle. If the satellite does not pass over ground station G, $\gamma$ increases to a maximum (say 50°) and then decreases. For the sake of completeness $\gamma$ is assumed to increase to 90°. In the following example, the ground station G is assumed to be at White Sands, N. Mex. (33.81776° N, 106.6592° W; altitude 1.5115 Km above sea level). The beam frequency is assumed to be 20 GHz.

The range x can be defined in terms of beam elevation angle $\gamma$ using the law of cosines in the triangle OGS $$(R+d)^2=R^2+x^2-Rx\cos(90+\gamma)$$

or $$x^2+2R\sin(\gamma)x-d(2R+d)=0$$

Additional path attenuation "La" with respect to attenuation at zenith due to elevation is then $$La(\gamma)=20\log(x/d)dB$$

Figure 4:
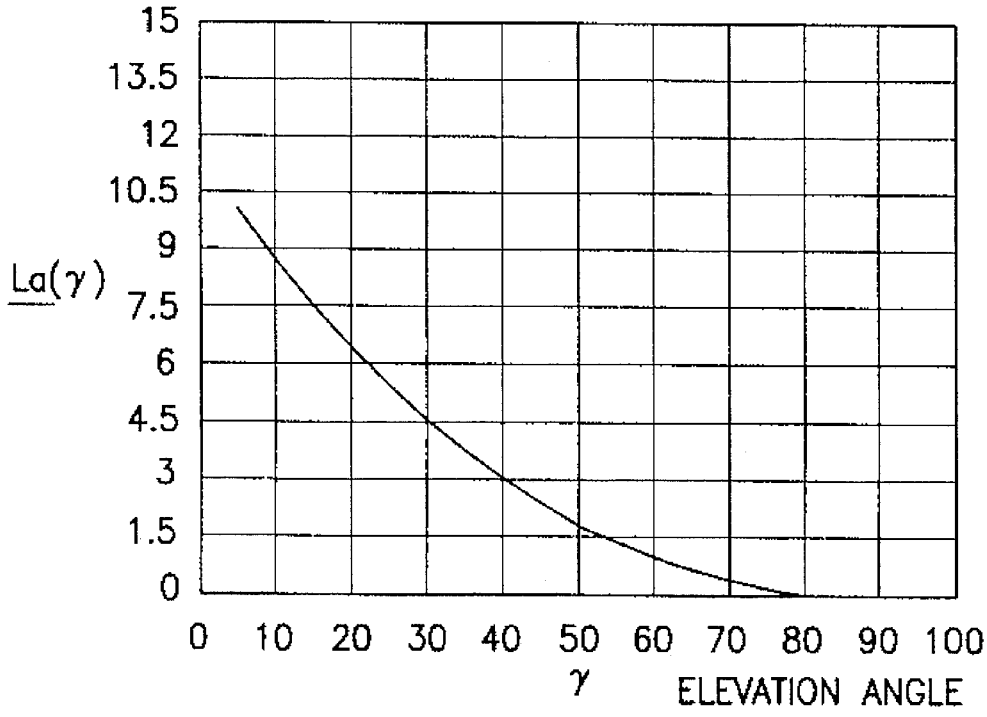
FIG. 4 is a plot of beam elevation angle versus additional free-space path attenuation for d=1,000 Km of a LEO satellite.

For a LEO satellite S orbiting at an altitude d=1,000 Km, the additional path attenuation La, as a function of beam elevation angle $\gamma$, is shown in FIG. 4.

Atmospheric attenuation (Lat), referenced to attenuation at zenith (at White Sands at 20 GHz assuming a relative humidity of 20% at 23° C.), is given by $$Lat(\gamma)=0.07/\sin(\gamma)-0.07\ \text{dB}$$

Figure 5:
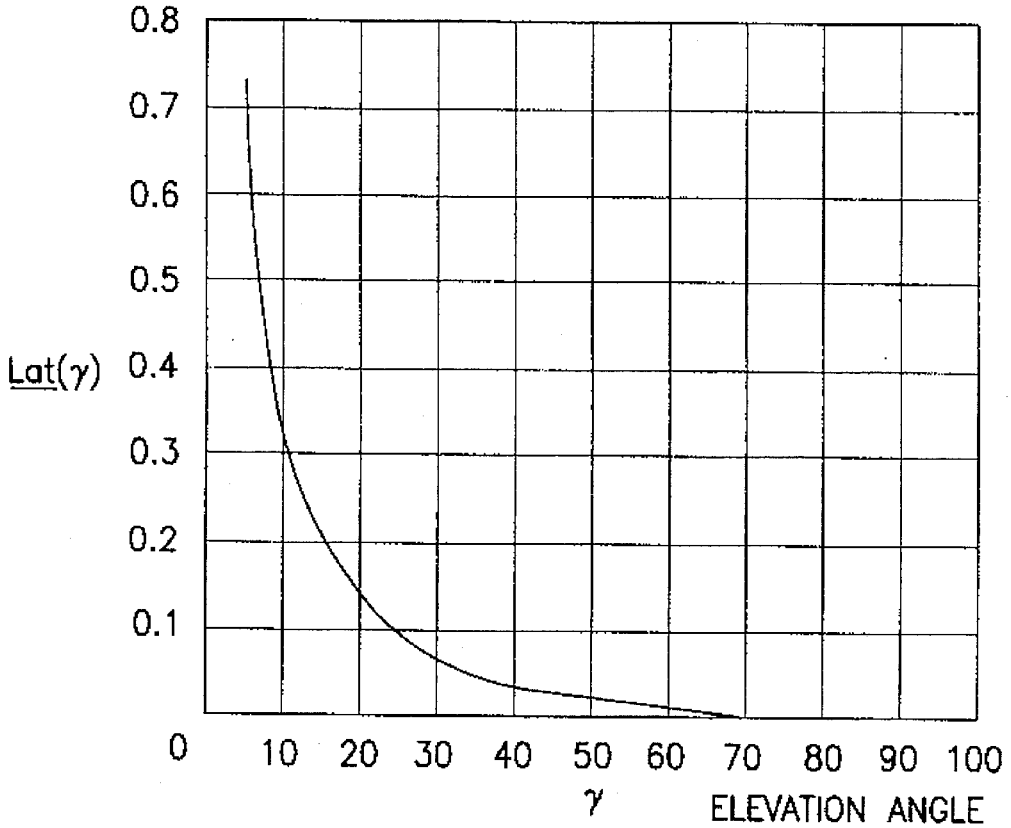
FIG. 5 is a plot of beam elevation angle versus attenuation due to atmospheric absorption at White Sands, N. Mex.

A plot of atmospheric attenuation versus beam elevation angle is shown in FIG. 5. Rain attenuation (Lr) referenced to attenuation at zenith, for 99.5% availability at White Sands at 20 GHz, is given by $$Lr(\gamma)=0.42/\tan(\gamma)dB$$

Figure 6:
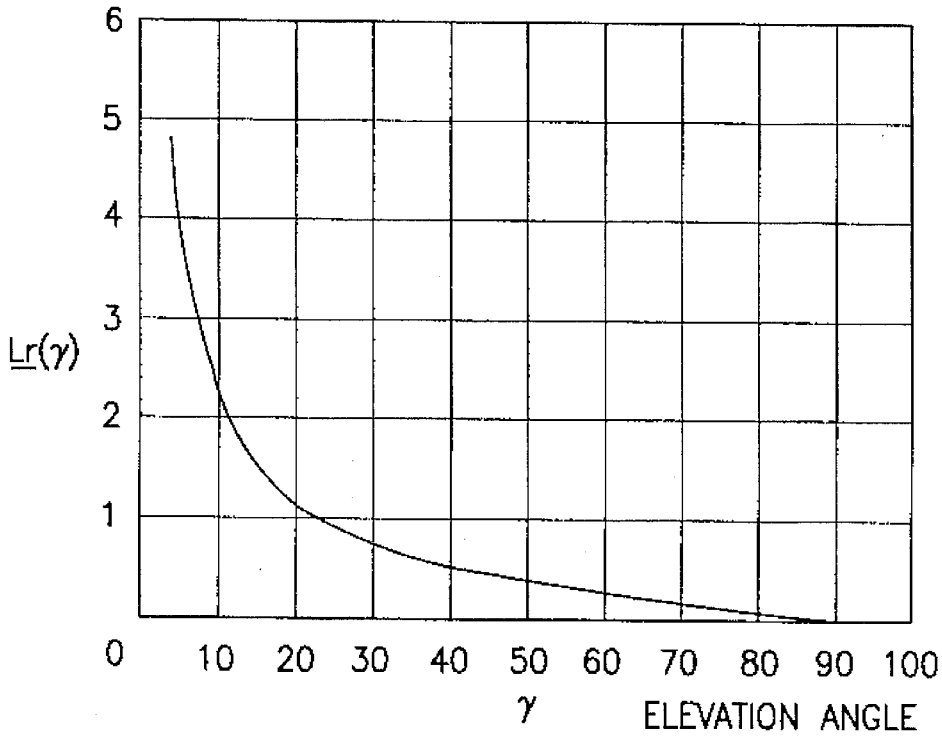
FIG. 6 is a plot of beam elevation angle versus attenuation due to rain at White Sands, N. Mex.

A plot of rain attenuation versus beam elevation angle at White Sands is shown in FIG. 6.

Total excess attenuation (Le), referenced to attenuation at zenith, due to elevation-based additional free space loss, atmospheric absorption and rain at White Sands at 20 GHz, is then $$Le(\gamma)=La(\gamma)+Lr(\gamma)+Lat(\gamma)dB$$

Figure 7:
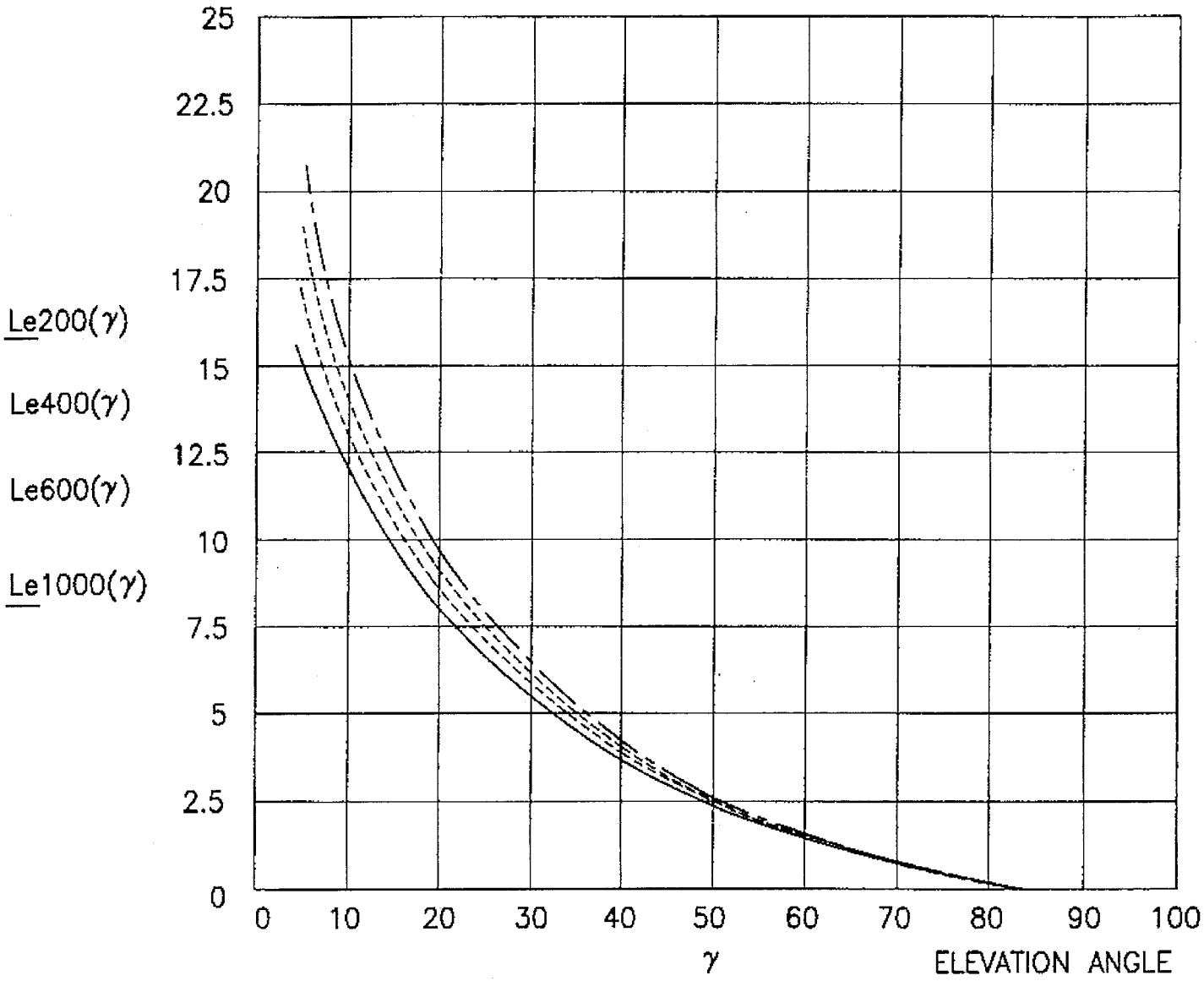
FIG. 7 is a plot of beam elevation angle versus excess attenuation at White Sands, N. Mex., for LEO satellite orbits at 200, 400, 600 and 1,000 Km.

FIG. 7 shows a plot of excess attenuation Le($\gamma$) versus beam elevation angle for satellite orbits at 200, 400, 600 and 1000 Km altitudes. FIG. 7 shows that excess attenuation (normalized to excess attenuation at zenith) increases significantly as beam elevation angle decreases toward the horizon, causing a significant elevation dependency of signal strength. This invention assures that antenna 10 exhibits an aperture wherein excess attenuation at the lowest specified beam angle is not greater than attenuation experienced at zenith.

The triangular pyramidal shape of antenna 10 (see FIG. 2) is defined by the height to base length ratio r=h/B. Each value of r, in turn, defines an active antenna face slant angle α. The gain G of each active antenna face, when a beam is steered to an angle θ off broadside, is:

$$G=(4\pi/\lambda^2)A\cos(\theta)=kA\cos(\theta)$$

The above expression does not consider effects due to feed response, coupling, polarization, scan blindness, etc. A normalized gain can be defined as $G_n=\cos(\theta)$. Since $\theta=90-(\alpha+\gamma)$, the gain is also a function of the elevation angle γ, once r (therefore α) is defined. The normalized gain of each face of the antenna with respect to gain at zenith is then $$G_{nr}(\gamma)=\cos(\theta)/\cos(\alpha)$$

where each value of r defines a different pyramid shape factor.

To assure that antenna 10 exhibits a gain function that compensates for variations in excess attenuation with the beam elevation angle, a function $dif_r$ is defined as:

$$dif_r(\gamma)=G_{nr}(\gamma)-Le(\gamma)dB$$

and is the difference between the normalized gain $G_{nr}$ for a given beam elevation angle, less the excess attenuation present at the given beam elevation angle Le(γ). $Dif_r$ should ideally be zero or a constant. As r is changed from 1 to 6, the graph of $dif_r(\gamma)$ is shown in FIG. 8.

Figure 8:
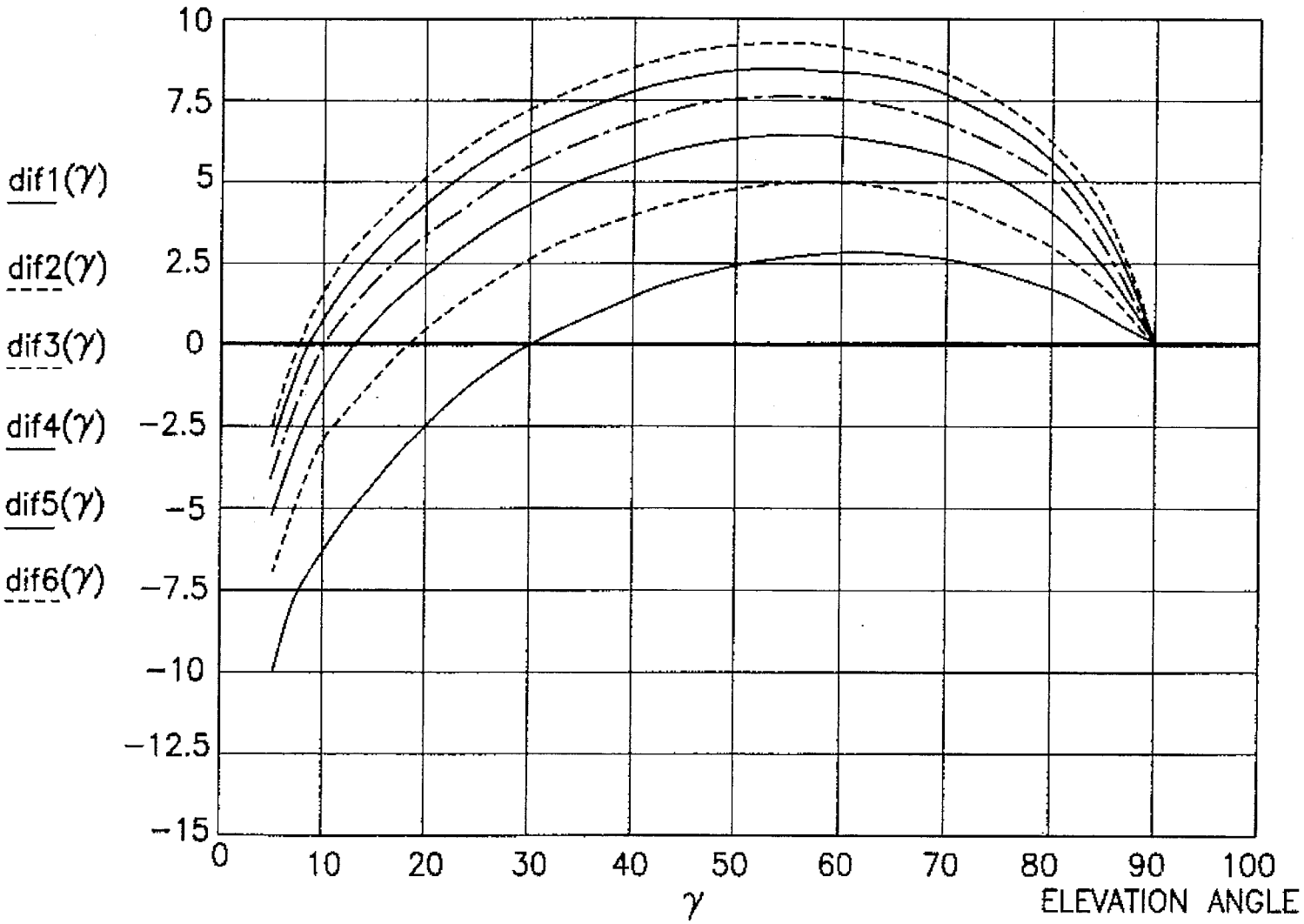
FIG. 8 is a plot of beam elevation angle versus a loss difference function as the ratio of h to B of the antenna geometry shown in FIG. 2A is varied between 1 and 6.

FIG. 8 shows that as the form factor of triangular, pyramidal, antenna 10 become lower and "squatter", that the beam elevation angle γ increases for which $dif_r(\gamma)$ is 0 or positive. For example, where the height to base ratio (r) is 1, the beam elevation angle must be at least 30° to satisfy the condition $dif_r(\gamma)\geqq$). At a height to base ratio (r) of 6, the beam elevation angle must be greater than 7° to satisfy the condition.

From FIG. 2A, the area of each face of a triangular pyramid is $$A=\tfrac{1}{2}Bm=\tfrac{1}{2}B^2\sqrt{(h/B^2+1/12)}=\tfrac{1}{2}B^2\sqrt{(r^2+1/12)}$$

When area A given in units of square meters or other unit of area, is normalized to the base area of the pyramid, it becomes $$A_o=(2/\sqrt{3})\sqrt{(r^2+1/12)}$$

Figure 9:
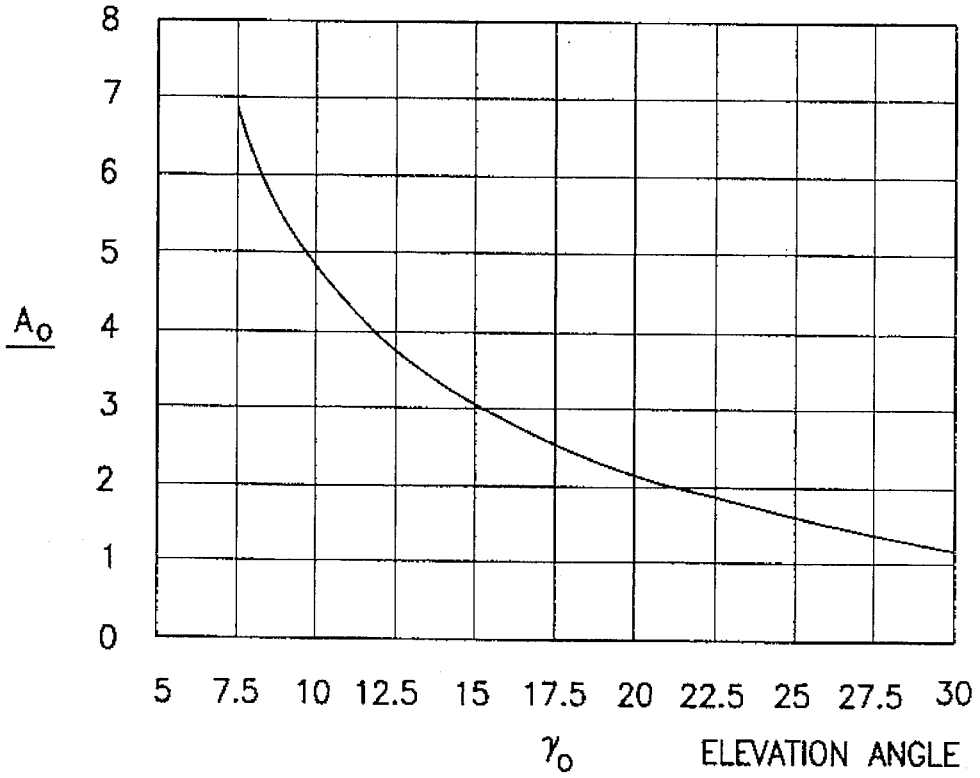
FIG. 9 is a plot of elevation angle versus a normalized area of each antenna face when compared to the elevation angle at which the loss difference function of FIG. 8 is zero.

The area of each triangular antenna face, as normalized to the base area of the triangular pyramid, varies between 7 and 1 for a variation in minimum beam elevation angle between 7.5 degrees and 30 degrees, respectively, as shown in FIG. 9.

FIG. 9 shows a graph of normalized area $A_o$ versus elevation angle $\gamma_o$=at which the function $dif_r(\gamma)$ is zero. It shows that to compensate for losses at lower elevation angles, taller pyramidal shapes are required. Since the area of each active face of antenna 10 is directly proportional to the cost of the phased array antenna, the graph also shows a plot of cost versus the elevation angle at which the function $dif_r(\gamma)$ is zero. The charts of FIGS. 8 and 9 thus enable an optimum choice of shape of a pyramidal phased array antenna, given a specified minimum beam elevation angle.

Figure 10A:
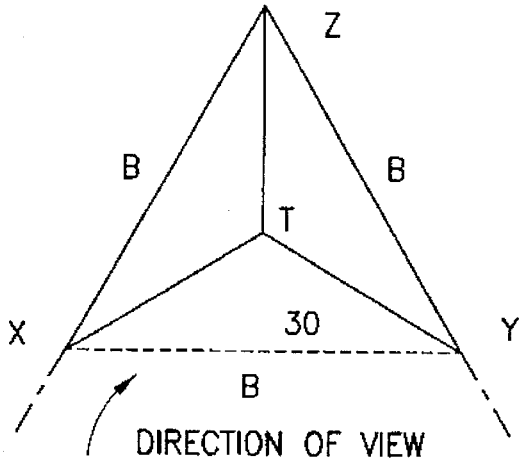
FIG. 10A illustrates a top view of the antenna geometry shown in FIG. 2A.
Figure 10B:
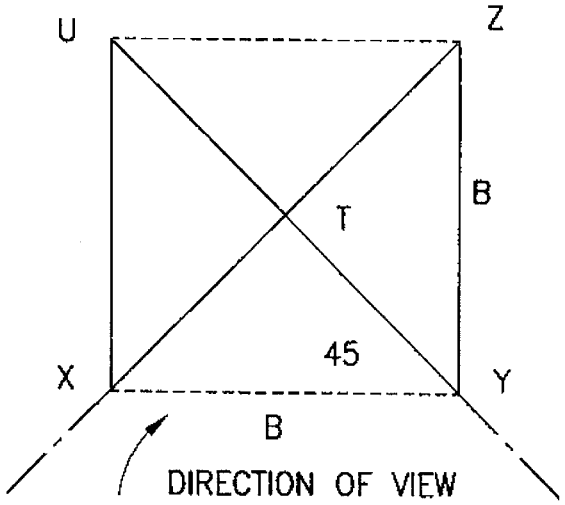
FIG. 10B is a top view of square-based pyramid.

It is readily demonstrated that the gain uniformity with azimuth of a triangular base, pyramidal, phased array antenna is superior to that of a square base pyramidal phased array. The gain of a phased array antenna is proportional to its projected area normal to the beam axis. In a triangular pyramidal antenna, the area changes from a maximum of $A_{tmax}=\tfrac{1}{2}Bh$ to $A_t=\tfrac{1}{2}Bh\cos(\rho)$, with a period of 30° where ρ is the azimuth angle. See FIG. 10A. The maximum change ratio is therefore $$R_t=A_t/A_{tmax}=1/\cos(30)=1.15 \text{ or } \pm0.31\ dB$$

For a square base pyramid antenna, the area changes from a maximum of $A_{max}=\tfrac{1}{2}Bh$ to $A_s=\tfrac{1}{2}Bh\cos(\rho)$ with a period of 45°. The maximum change ratio is $$R_s=A_s/A_{smax}=1/\cos(45)=1.41 \text{ or } \pm0.75\ dB$$

Triangular base pyramid antennas therefore exhibit less variation of aperture cross section with azimuth than square pyramid antennas, (i.e., ±0.31 dB versus ±0.75 dB).

It can be seen from the above that a triangular, pyramidal, phased array antenna, constructed in accordance with the invention, exhibits a greater gain (i.e., a larger aperture) at a minimum beam elevation angle. The larger aperture compensates for greater additional losses experienced by a satellite signal at the minimum beam elevation angle (the "additional losses" being those that are over and above losses experienced by a signal traversing a beam path when the satellite is at zenith). The invention provides a larger projected antenna area which compensates for additional beam path losses at low elevation angles.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A phased array antenna comprising:

three triangular shaped antenna faces meeting at a common vertex, each antenna face including an array of antenna elements, said three antenna faces juxtaposed to form a triangular pyramid, said triangular pyramid having a height h and at least one base leg of length B, h and B exhibiting ratio which provides a triangular pyramid shape for said antenna that assures a first antenna aperture at a minimum beam elevation angle that is larger than a second antenna aperture when said beam elevation angle is at zenith, said first aperture and said second aperture exhibiting a ratio of areas that is at least equal to a ratio of additional losses experienced by a beam at said minimum beam elevation angle to additional losses experienced by a beam at a zenith elevation angle, additional losses being the sum of losses resulting from at least rain, path length and atmospheric attenuation.

2. The phased array antenna as recited in claim 1, wherein each base leg of said triangular pyramid shape exhibits a length B.

3. The phased array antenna as recited in claim 2, wherein said ratio of said h to B increases for decreasing values of minimum beam elevation angles to provide said first antenna aperture at said lesser minimum beam elevation angles.

4. The phased array as recited in claim 3, wherein an area of each triangular antenna face, as normalized to a base area of said triangular pyramid, varies between 7 and 1 units of area measure for a variation in minimum beam elevation angles between 7.5° and 30°, respectively.

* * * * *